US010144190B2

(12) United States Patent
Carey

(10) Patent No.: US 10,144,190 B2
(45) Date of Patent: Dec. 4, 2018

(54) PUNCH AND SCORING SYSTEM

(71) Applicant: American Crafts, L.C., Orem, UT (US)

(72) Inventor: Tavnir John Carey, West Jordan, UT (US)

(73) Assignee: American Crafts, L.C., Lindon, UT (US)

( * ) Notice: Subject to any disclaimer, the term of this patent is extended or adjusted under 35 U.S.C. 154(b) by 994 days.

(21) Appl. No.: 14/019,248

(22) Filed: Sep. 5, 2013

(65) Prior Publication Data

US 2015/0027289 A1 Jan. 29, 2015

Related U.S. Application Data

(60) Provisional application No. 61/857,784, filed on Jul. 24, 2013.

(51) Int. Cl.

| | |
|---|---|
| ***B31B 47/02*** | (2006.01) |
| ***B26F 1/44*** | (2006.01) |
| ***B26D 3/08*** | (2006.01) |
| ***B26D 9/00*** | (2006.01) |
| ***B26D 7/00*** | (2006.01) |
| ***B26F 1/12*** | (2006.01) |

(Continued)

(52) U.S. Cl.

CPC ..... *B31B 47/02* (2013.01); *B26D 3/085* (2013.01); *B26D 7/0006* (2013.01); *B26D 9/00* (2013.01); *B26F 1/12* (2013.01); *B26F 1/44* (2013.01); *B26F 2001/4481* (2013.01); *B31B 70/148* (2017.08); *B31B 70/20* (2017.08); *B31B 70/25* (2017.08); *B31B 2150/00* (2017.08); *B31B 2160/102* (2017.08); *B31B 2247/00* (2013.01); *Y10T 83/0207* (2015.04)

(58) Field of Classification Search

CPC ..... Y10T 83/0385; Y10T 83/0207; Y10T 83/0333; Y10T 83/9423; Y10T 83/9442; Y10T 83/9428; Y10T 83/9437; B31B 47/00; B31B 47/02; B31B 47/04; B31B 49/00; B31B 49/02; B31B 49/04; B31B 2247/00; B26D 9/00; B26F 1/38; B26F 1/32; B26F 2001/4481; Y10S 83/911

USPC ..... 493/51, 52, 56–59, 162, 240, 242, 243

See application file for complete search history.

(56) References Cited

U.S. PATENT DOCUMENTS 2,718,828 A * 9/1955 Buda ..... B31B 21/00 229/68.1

3,257,885 A * 6/1966 Hornung ..... B31B 1/24 83/346

(Continued)

*Primary Examiner* — Phong Nguyen

(74) *Attorney, Agent, or Firm* — Durham Jones & Pinegar, P.C., Intellectual Property Law Group

(57) ABSTRACT

A device for punching and scoring a medium includes a punch tool and a grooved score guide. The punch tool has a cutter configured to cut an edge of a sheet of the medium. The positioning edge is disposed on the device and configured to guide an edge of the medium and position the medium with respect to the punch tool. The grooved score guide is formed in the device and configured to match a scoring tool to create a score line in the medium. The arrangement between the punch tool and positioning edge is configured to cut a notch in the edge of the medium at a notch point. The grooved score line is disposed in relationship to the punch tool to create the score line in the medium from the notch point across the medium.

20 Claims, 7 Drawing Sheets

(51) Int. Cl.

| | |
|---|---|
| *B31B 70/20* | (2017.01) |
| *B31B 150/00* | (2017.01) |
| *B31B 70/14* | (2017.01) |
| *B31B 70/00* | (2017.01) |
| *B31B 160/10* | (2017.01) |

(56) References Cited

U.S. PATENT DOCUMENTS

| | | | | |
|---|---|---|---|---|
| 3,279,290 | A * | 10/1966 | Stemmler | B31B 21/00 198/457.07 |
| 5,518,491 | A * | 5/1996 | Romer | B31B 47/02 229/68.1 |
| 6,560,891 | B1 * | 5/2003 | Arnold | B26F 1/36 33/564 |
| 6,742,431 | B1 * | 6/2004 | Oh | B26F 1/04 30/358 |
| 7,753,833 | B2 * | 7/2010 | Crick | B31F 1/08 493/160 |
| 2004/0149108 | A1 * | 8/2004 | McLean | B23D 35/008 83/614 |
| 2005/0211041 | A1 * | 9/2005 | Oh | B26F 1/36 83/588 |
| 2011/0041662 | A1 * | 2/2011 | Lynen | B26D 7/015 83/39 |
| 2012/0125173 | A1 * | 5/2012 | Nelson | B26D 1/065 83/886 |
| 2012/0174719 | A1 * | 7/2012 | Kaufman | B26F 1/04 83/23 |
| 2012/0192691 | A1 * | 8/2012 | Hiller | B26F 1/04 83/39 |

* cited by examiner

PUNCH AND SCORING SYSTEM

CROSS-REFERENCE TO RELATED APPLICATIONS

This application claims the benefit of and is a Non-Provisional of U.S. Application No. 61/857,784 filed Jul. 24, 2013. The entire disclosure of the prior application is hereby incorporated by reference in its entirety.

BACKGROUND OF THE INVENTION

1. The Field of the Invention

The present invention relates to a punch and scoring system, and more particularly, to a punch and scoring system for making envelopes, bags, boxes, containers and the like.

2. The Relevant Technology

There are various methods for designing and making envelopes. One of the concepts in the past has been to provide a mass produced envelope whereby hundreds of envelopes may be produced at a given size for the purpose of selling them in quantities on the open market. This is perhaps the best option for low cost envelopes where a standard size and color envelope is required.

An example of an early small production envelope is discussed in U.S. Pat. No. 1,879,624, by R. L. Lockwood, entitled "Apparatus for Making Envelopes", dated May 31, 1930. A template enables the user to trace five different sizes of envelopes. Once a template is traced onto a piece of paper, the user can then cutout the pattern traced on the paper with scissors. With the paper cut in the proper configuration, the corners of the paper can then be folded by utilizing a flat rectangular folding plate which will determine the final size of the envelope. To accomplish this, the rectangular folding plate is placed over the paper pattern at the center of the pattern. Care should be taken to make sure that the rectangular folding plate is placed exactly at the center of the paper cutout. There are no marks or indicators of where this rectangular folding plate should be placed, but it should be fairly evident that you are not to place it over any of the cut edges of the paper cutout edges. These cutouts extend to the very edge of this rectangular folding plate as it is placed on the paper. The four corners of the paper cutout may then be folded over that rectangular folding plate, creating the edge or pattern of each of the folds. This requires four folds to be made in the pattern. Once the four folds have been set in the paper cutout, the rectangular folding plate will then be removed and the paper cutout will then be folded together at each one of its corners. The final step is to glue the four tabs of the envelope together, forming an envelope.

With this device, only a limited number of envelope sizes are allowed to be made. Not only that, the pattern design is cutout after marking the paper with a pencil or pen. The design incorporates several intricate angled sides and therefore does require some dexterity to not only trace around the pattern, but to cutout the pattern with scissors.

Another approach to this issue is described in U.S. Pat. No. 5,518,491, by Romer et al., entitled "Envelope Maker and a Method of Using," dated May 21, 1996. This device reduces the intricacy of the work required to make an envelope, but it only allows one size of envelope to be made from the pattern.

A template is provided that the user will utilize to trace around the exterior edges of the template with a pen or pencil. In this case, the paper or other medium to be made into an envelope results in a square piece of paper with one of the corners clipped off. Therefore, it is a simplified template and paper cutout as compared to the previous pattern discussed. Once the paper cutout is traced from the template, scissors are utilized to cutout along the lines created by this traced line on the paper. The cutout involves just four simple cuts with the scissors and can be accomplished by someone with limited dexterity. Once the paper is cutout to match the template pattern, the paper is then laid on the template in the same orientation as the template pattern itself.

The template has a rectangular cutout in its center section that is on a 45 degree angle to the outside edges of the template. This cutout is slightly larger than a separate flat folding plate that is utilized as a mechanism to provide fold lines in the paper cutout. To determine where the fold line will be on the paper cutout, the user places the paper cutout over the template in the same exact orientation as the template configuration itself. The user, by feeling through the paper cutout, can recognize the outline of the rectangular cutout. Knowing where the cutout is, the user may then insert the flat folding plate over that cutout and press down, sandwiching the paper between the flat folding plate and the template and pressing the paper cutout into the hole of the template. This creates the fold line demarcations for the user to be able to discern where the paper cutout should be folded when this paper cutout is removed from between the template and the flat folding plate. Once the paper cutout has been folded, the final step is to glue the tabs of the paper cutout to each other to create the envelope.

This simplified format for making an envelope has some improvement over the first method mentioned above, but the inability to make several sizes of envelopes is a major deficiency. It may be a simple approach to making an envelope, but another disadvantage to this design is that when the corners of the paper cutout are folded together to form an envelope, the paper cutout at the edges end up with their corners being four layers thick, instead of two layers thick. This is because there are no cutouts in the inside corners to allow for a fold to occur without a double overlap of the corners. This double overlap could create a problem for gluing the corners together due to the bunching up of material in each corner.

To rectify one of the deficiencies mentioned in the above patent, the author developed an improvement in U.S. Pat. No. 5,685,816, entitled "Envelope Maker and Method of Use", by Nicholas K. Romer, dated Nov. 11, 1997. The '816 Patent allowed for a couple of different sizes of envelopes to be made from the same template as opposed to the single size envelope offered in the first invention. This design, however, still has the problem that the folded corners of the paper cutout, where the two adjacent corners meet, have a double fold of paper because the corners are not cutout allowing the paper to fold over as a single sheet. Thus there are four thicknesses of paper in each corner, instead of two if there was a corner cutout.

Another example of a template design that allowed the making of single envelopes is described in U.S. Pat. No. 6,635,003 B2 by Merchant, entitled "Method for Laying Out Envelope Blank," dated Oct. 21, 2003. One of the deficiencies of the previous designs for making a one-off envelope is that there is only a limited number of sizes of envelopes possible. The '003 Patent is an attempt to provide a mechanism to allow multiple sizes of envelopes to be made. An adjustable template is provided that allows the user to be able to lay this template over the top of a card the user wishes to insert into an envelope. This template is adjustable so that it may be opened to the point that it mimics the outer limits of the size of the card that will be inserted into the envelope. With the adjustable template set to the size of the card, the template may then be transformed to another template that is in graphical form. This graphical template in combination with the adjustable template is what is required to be able to size the cut lines for the envelope that will fit the card that goes in the inside of the envelope. With both the templates superimposed on top of a sheet of paper, a series of points may be drawn on the paper. Connecting the point drawn on the paper and drawing a line from one point to the other will indicate the cut line required to form the envelope. Utilizing the adjustable template the user may then mark a "V" cutout for each of the corners of the envelope. This "V" cut allowed the edges of each of the flaps, when folded together, to overlap. This eliminated the need for the four layer fold at each of the corners of each of the four flaps that was the case in the prior two examples.

The drawback to this design is the complexity of the templates and how to use them. There is a greater chance for error in how to place the two templates together, how to utilize the graphical template to form the points of the pattern to be cut, where the cutout for the corners are to be placed and also how difficult it is to follow the intricate pattern when cutting out the pattern. There are many angular cuts required as well as four small triangular cutouts at each of what will become the four inside corners of the envelope. This design requires a lot of skill to use.

To summarize concerning the prior art, it may be stated that prior apparatuses for making envelopes lacked at least one of these features: simplicity (in ease of use and ease of repeated consistency), and the ability to be able to make multiple sizes of envelopes at the discretion of the user. The advantage of the envelope punch and scoring system is that it overcomes all these disadvantages.

BRIEF SUMMARY OF VARIOUS EMBODIMENTS

This summary is provided to introduce a selection of concepts in a simplified form that are further described below in the Detailed Description. This summary is not intended to identify key features or essential characteristics of the claimed subject matter, nor is it intended to be used as an aid in determining the scope of the claimed subject matter.

In at least one example, a device for punching and scoring a medium includes a punch tool and a grooved score guide. The punch tool has a cutter configured to cut an edge of a sheet of the medium. The positioning edge is disposed on the device and configured to guide an edge of the medium and position the medium with respect to the punch tool. The grooved score guide is formed in the device and configured to match a scoring tool to create a score line in the medium. The arrangement between the punch tool and positioning edge is configured to cut a notch in the edge of the medium at a notch point. The grooved score line is disposed in relationship to the punch tool to create the score line in the medium from the notch point across the medium.

In another example, an apparatus for punching and scoring paper creates an envelope. The apparatus includes a main body, a punching tool and a grooved score guide. The punch tool is disposed on the main body, having a first and second cutting tool with a single actuation point. The first cutting tool is configured to cut a "V" cut at a notch point in the medium. The second cutting tool is configured to cut a corner radius on a flap in the medium. The grooved score guide is formed in the main body and configured to match a scoring tool to create a score line in the medium. The grooved score line is disposed in relationship to the punch tool to create the score line in the medium from the notch point across the medium.

In a further example, a device for punching and scoring paper creates an envelope. The device includes a main body, a punch tool, a positioning edge, and a grooved score guide. The punch tool is disposed on the main body, having a first and second cutting tool with a single actuation point. The first cutting tool is configured to cut a "V" cut at a notch point in the medium. The second cutting tool is configured to cut a corner radius on a flap in the medium. The first cutting tool is positioned opposite the second cutting tool. The positioning edge is disposed on the main body and configured to guide an edge of the medium and position the medium with respect to the punch tool. The grooved score guide is formed in the main body and configured to match a scoring tool to create a score line in the medium. The grooved score line is disposed in relationship to the punch tool to create the score line in the medium from the notch point across the medium.

These and other objects and features of the present invention will become more fully apparent from the following description and appended claims, or may be learned by the practice of the invention as set forth hereinafter.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE VARIOUS EMBODIMENTS

The embodiments of the punch and scoring system are provided for a user to fabricate an envelope of various sizes with paper or other medium typically used in arts and crafts. The punch and scoring system can also be used to make bags, boxes, and containers made from paper or other mediums. Directions on how to make the container may be emblazoned on a surface of the device. Additionally, all the tools to fabricate a container with a sheet of paper may be included with the system.

Figure 1:
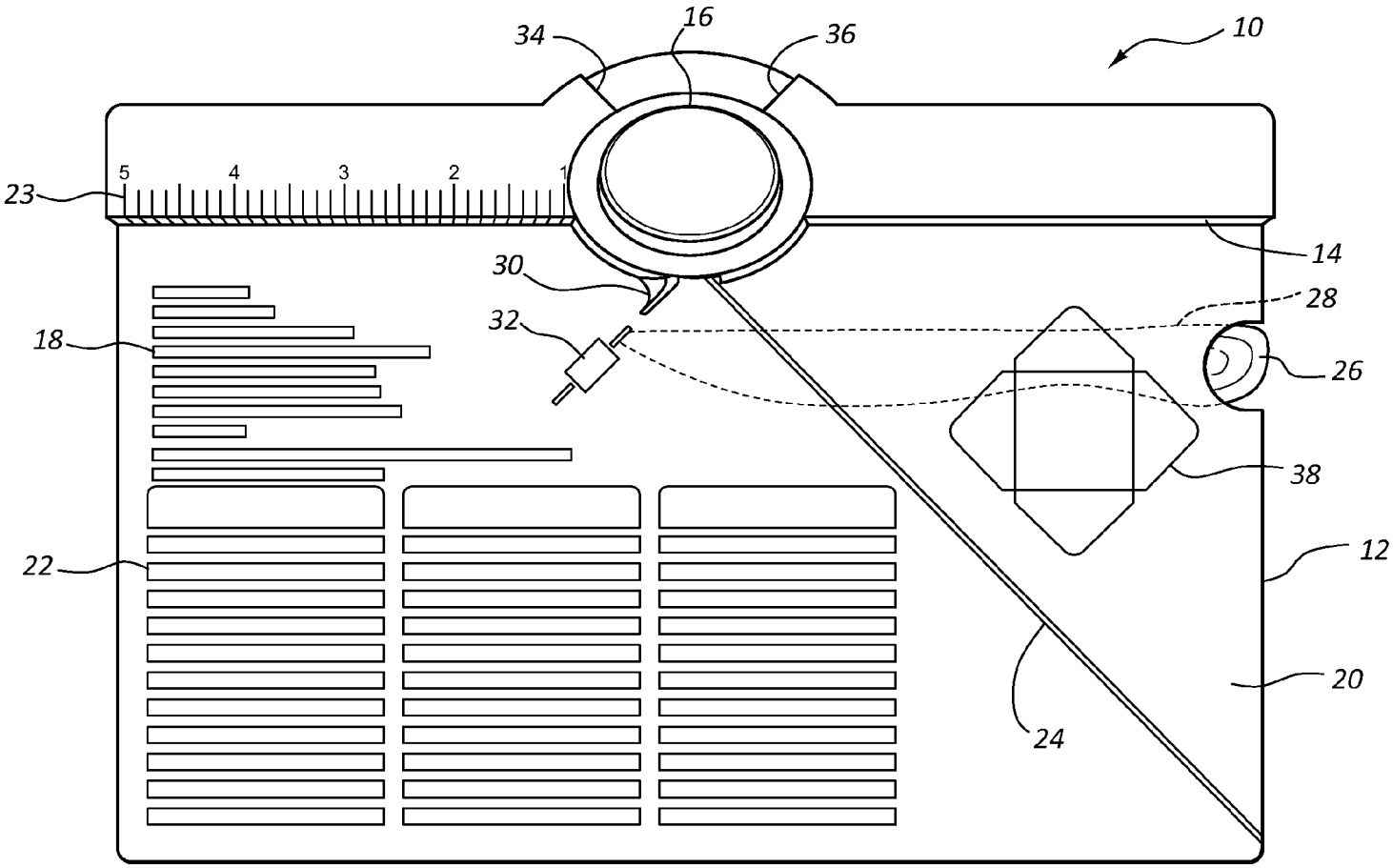
FIG. 1 is a top view of the punch and scoring system.

FIG. 1 illustrates the top view of the punch and scoring system 10. The main body 12 of the punch and scoring system 10 (also referred to as a "system") can be fabricated from a reinforced plastic material. Along one of the long edges of the main body 12 is configured a positioning edge 14 that may be utilized to position the paper that is to be fabricated into an envelope, bags, boxes, containers and the like. The positioning edge 14 disposed on the main body 12 and configured to guide an edge of the medium and position the medium with respect to a punch tool 16. The positioning edge 14 provides an elevated edge that can be 90 degrees to the main body 12 surface. The punch tool 16 includes a cutter that is configured to cut an edge of a sheet of the medium. The punch tool 16 can be located at the middle of the positioning edge 14. This punch tool 16 may be used to punch desirable patterns in the paper to be made into envelopes, bags, boxes, containers and the like.

This system 10, for example, allows the user to be able to fabricate multiple sizes of envelopes. To instruct the user on how to use and later recall how to use the punch and scoring system, a detailed set of instructions 18 may be provided on the upper face 20 of the device below the positioning edge 14. A sizing scale 22 may also be provided with the instructions 18. The instructions 18 and sizing scale 22 can be placed on the device to assist a user to punch and score the medium for a given size. This sizing scale 22 is provided so that the user may utilize this sizing scale 22 to determine the size of paper required based on the desired card or other material that is to be inserted into a finished fabricated envelope.

An edge scale 23 is located on the edge of the positioning edge 14 to ascertain certain locating features in fabricating the envelope and to assist the user in positioning the medium at a proper location along the positioning edge 14. Once paper has been properly located on the main body 12 and located properly with the edge scale 23, then multiple functions can been accomplished in conjunction with the punch tool 16 and a grooved score guide 24. The grooved score guide 24 is formed in the device and configured to match a scoring tool 26 to create a score line in the medium. The grooved score guide 24 is used in conjunction with the scoring tool 26 that is included with the punch and scoring system 10 and positioned within a scoring tool slot 28. The arrangement between the punch tool 16 and positioning edge 14 is configured to cut a notch in the edge of the medium at a notch point. The grooved score guide 24 is disposed in relationship to the punch tool 16 to create a score line in the medium from the notch point across the medium. A score guide locator 30 is provided to assist in locating the paper in the proper position to effect this punching operation and scoring of the paper. A score guide instructional arrow 32 is provided on the main body 12 to point to the score guide locator 30 and indicate the location of this score guide locator 30.

The punch tool 16 may be utilized for cutting both concave "V" cuts and corner radiuses into a piece of paper or other medium that will be made into an envelope. If the punch tool 16 is utilized on the side of the main body 10 where the grooved score guide 24 is located, it will create a concave "V" cut in the paper or other medium. Conversely, if the other side of the punch tool 16 (the outside of the main body 12) is utilized, a convex cut in the shape of one fourth of a circle (corner radius) will be affected. The locating feature for this punch tool 16 to affect a corner radius cut are the two vertical sides of the first corner guide 34 and the second corner guide 36. The first corner guide 34 and the second corner guide 36 are configured to position the medium with respect to the punch tool 16.

The finished envelope flat pattern diagram 38 is depicted on the main body 12 of the punch and scoring system 10 opposite the instructions 18. The diagram 38 illustrates a finished product for a punched and scored medium. This diagram 38 also affords a pictorial representation of how the completed paper or other medium flat pattern is to appear.

Figure 2:
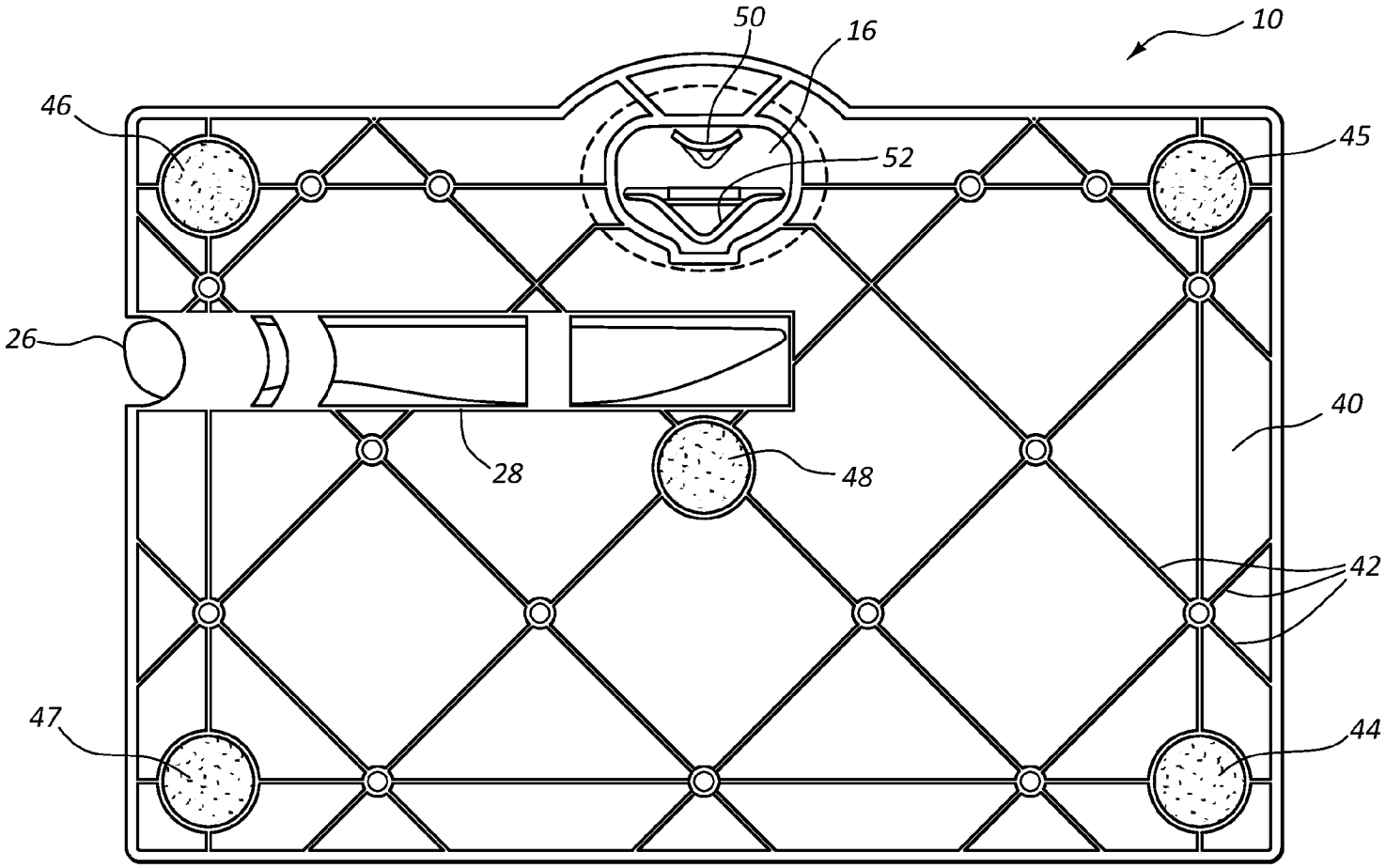
FIG. 2 is bottom view of the punch and scoring system.

FIG. 2 shows a view of the bottom face 40 of the punch and scoring system 10. To give the device adequate strength, a series of stiffeners perpendicular to the main body 12 (FIG. 1) are placed on the bottom face 40 of the device. This system includes a reinforcing rib structure 42. To effect a device that will be cushioned and not allow slipping when placed on a table, five cushioning pads 44, 45, 46, 47, 48 are provided. A view of the scoring tool 26 and the scoring tool slot 28 (FIG. 1) may be seen. The scoring tool slot 28 is provided within the depth of the reinforcing rib structure 42 and parallel to the longest length of the bottom face 40.

A feature of this embodiment is the punch tool 16. This punch tool 16 includes a cutter that may have two cutting surfaces. One cutting surface, the convex cutting tool (or first cutting tool) 50 provides a cut that makes a smooth radial convex cut and the other concave cutting tool (or second cutting tool) 52 offers a "V" concave cut where the bottom of the "V" is rounded forming a concave "V" cut. The concave and convex cut may each provide about one quarter of a circle radius. The first cutting tool 50 and the second cutting tool 52 are actuated by the same punch tool 16, such that when depressed, both cutting surfaces are actuated together. The first cutting tool 50 and the second cutting tool 52 may both be actuated at the same time by the pressing the punch tool 16. The first cutting tool 50 is configured to cut the medium at the notch point and the second cutting tool 52 is configured to cut a corner radius in a flap cut in the medium. The first cutting tool 50 may be positioned opposite the second cutting tool 52. As discussed above, the first and second corner guides may be configured to position the medium with respect to the second cutting tool 52.

Figure 3:
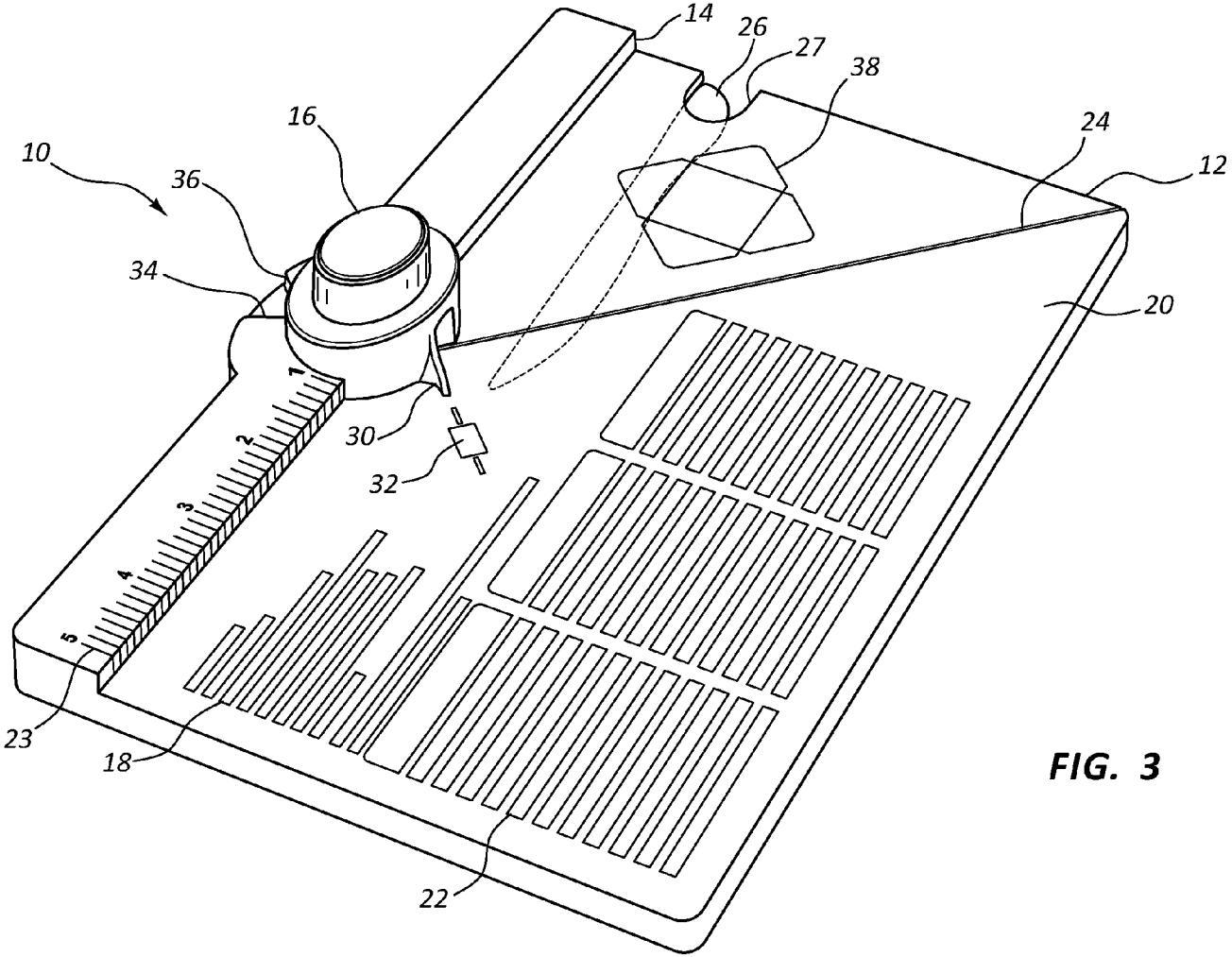
FIG. 3 is an isometric view of the punch and scoring system.

FIG. 3 illustrates the punch and scoring system 10. This view allows one to see the depth of the various features of the device. Along one of the long edges of the main body 12 is configured an elevated positioning edge 14 that may be utilized to position the paper that is to be fabricated into an envelope. As may be seen in this view, an elevated positioning edge 14 is provided that is 90 degrees to the main body 12 surface. The punch tool 16 is located at the middle of the positioning edge 14.

The relative location of the instructions 18 is visible, as well as the sizing scale 22. The detailed set of instructions 18 have been provided on the upper face 20 of the device, immediately below the positioning edge 14. Below the instructions 18 is the sizing scale 22.

An edge scale 23 is located on the edge of the positioning edge 14 to ascertain certain locating features in fabricating the envelope. Once paper or other medium has been properly located on the main body 12 and located properly in relation to the edge scale 23, then a grooved score guide 24 is provided to accurately locate a fold line location. This grooved score guide 24 is used in conjunction with the scoring tool 26 that is included with the punch and scoring system 10 and positioned within a scoring tool slot 28 (FIGS. 1 and 2), with an end of a handle of the scoring tool 26 exposed in a recess 27 in an edge of the main body 12, and to which the scoring tool slot 28 opens. The score guide locator 30 is provided to assist in locating the paper in the proper position to effect this scoring of the paper or other medium. A score guide instructional arrow 32 is included on the main body 12 indicating the location of this score guide locator 30.

The punch tool 16 as shown in this figure depicts its position in relation to the upper face 20. The punch tool 16 is a button that is attached to the punch devices that create the two types of cuts in the paper utilized for the envelopes. When this punch tool 16 button is depressed one dual facing die or two separate dies is/are actuated that cut both a concave slot and a convex slot into a piece of paper that will be made into an envelope. If the punch tool 16 is utilized on the side of the main body 12 where the grooved score guide 24 is located, it will create a concave cutout in the shape of a "V" with a slightly rounded corner at the bottom of the "V", or concave "V" cut. Conversely, if the other side of the punch tool 16 (the outside of the main body 12) is utilized, a convex cut in the shape of one fourth of a circle will produce a corner radius. The locating feature for this punch tool 16 to effect this corner radius are the two vertical sides of the first corner guide 34 and the second corner guide 36.

The finished envelope flat pattern diagram 38 may also be depicted on the main body 12 of the punch and scoring system 10 to help illustrate the instructions 18 and sizing scale 22.

Figure 4:
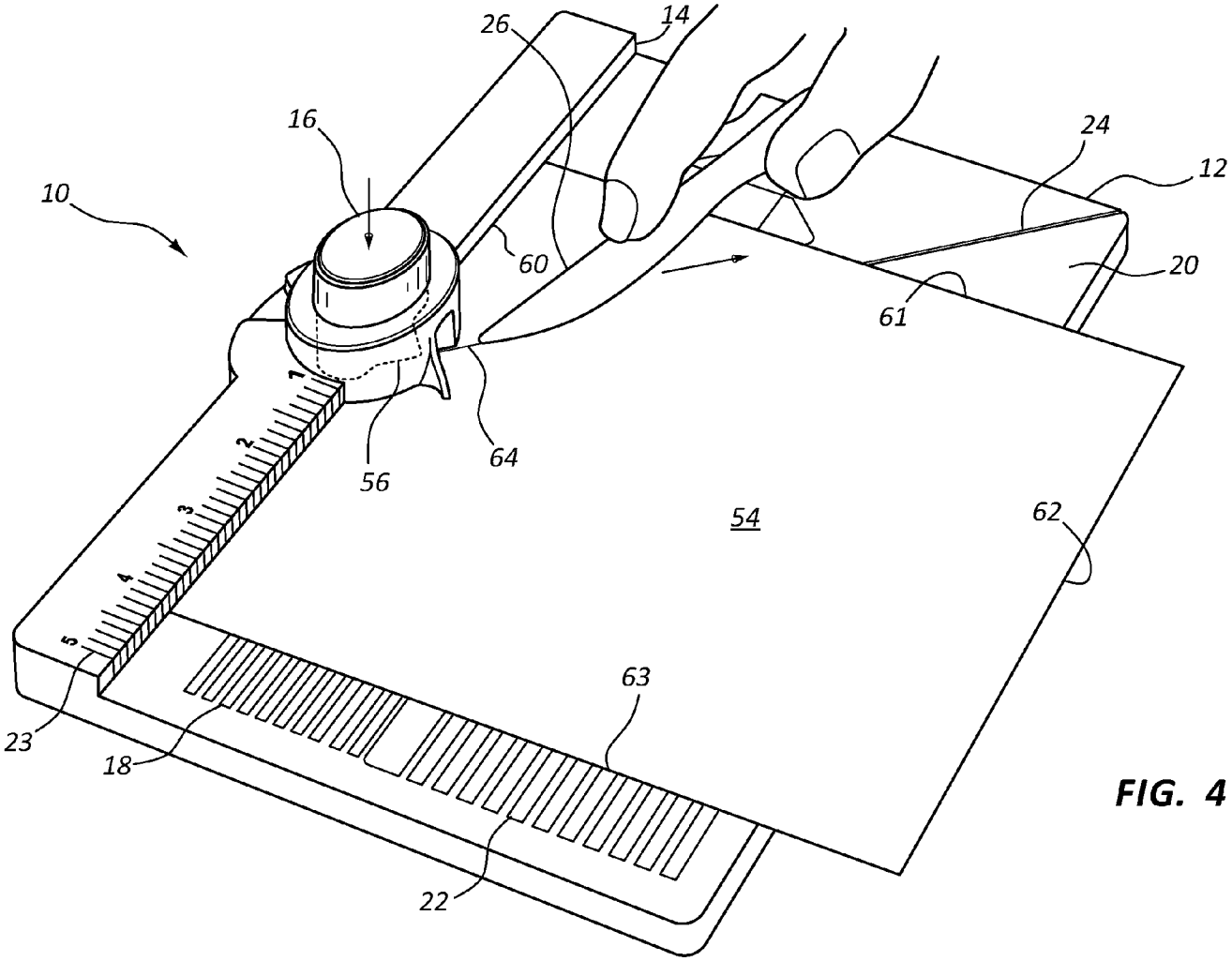
FIG. 4 is a three-dimensional drawing depicting the use of the scoring tool on a sheet of paper or other medium.

FIG. 4 illustrates the punch and scoring system 10 which shows the interaction of this embodiment with a sheet of paper or other medium 54 that has been precut to the size required on the instructions 18 provided on the upper face 20 of the device. After selecting the size of the card or other medium that is to be inserted into the envelope that is to be fabricated, the user takes a piece of paper or other medium 54 and cuts it to the required dimensions as shown on the instructions 18. Subsequent to the paper or other medium 54 being cut to the proper size, the paper or other medium 54 is then placed at the prescribed dimension as indicated under the "score line" on the instructions 18. Referring to that score line dimension on the instructions 18, the paper edge 60 (the paper or other medium 54 may also include other paper edges 61, 62, 63, etc.) is then placed against the edge scale 23, with the corner of the paper edge 60 being placed at the corresponding dimension as indicated for the score line dimension in the instructions 18.

The user will then push the paper or other medium 54 tightly up against the positioning edge 14 and under the punch tool 16. With this paper or other medium 54 located in the proper place with the paper edge 60 immediately adjacent to the prescribed score line number on the edge scale 23 and with the paper edge 61 held tightly against the positioning edge 14, the user may then press the punch tool 16 down as indicated by the vertical down arrow on the drawing. This will provide a concave "V" cut 56 in the paper or other medium 54 at the center of the paper edge 60. The concave "V" cut is a modified "V" with the lower notch of the "V" with a rounded corner (similar to a "U" and a "V" combined).

Subsequent to the paper or other medium 54 being punched forming this concave "V" cut 56 at the center of the paper edge 60 of the paper or other medium 54, the user then extracts the scoring tool 26 from the scoring tool slot 28 (FIGS. 1 and 2). The scoring tool 26 is in the shape of a knife, but may be fabricated from a somewhat flexible plastic or other similar material. The scoring tool 26 has a dull cutting edge so that it won't damage the paper or other medium 54 when the scoring tool 26 is used to score or indent the paper or other medium 54. The scoring tool 26 is also narrow enough to fit into the grooved score guide 24 while it pushes the paper into the grooved score guide 24. The paper or other medium 54 should be held in place making sure that the paper edge 60 has not moved from the proper edge scale 23 location. In other words, the paper or other medium 54 should be held in the same place as it was when making the concave "V" cut 56 and the paper or other medium 54 should not be allowed to move. If it has moved, then the user would need to make whatever adjustment is required to line up the corner of the paper or other medium 54 with the proper score line dimension on the edge scale 23. When the paper edge 60 is properly lined up and held in place, the user then applies pressure with the scoring tool 26 on top of the paper or other medium 54 immediately over the grooved score guide 24. The scoring tool 26 is then dragged over the top of the paper or other medium 54 while at the same time making sure that the scoring tool 26 remains in the grooved score guide 24. The paper or other medium 54 should be scored by the scoring tool 26 so that the width of the paper or other medium 54 from the punch tool housing 68 to the paper edge 60 is scored with a score line 64. This grooved score guide 24 and associated score line 64, is at an angle of about 45 degrees to the edge scale 23 and the paper edge 60.

Figure 5:
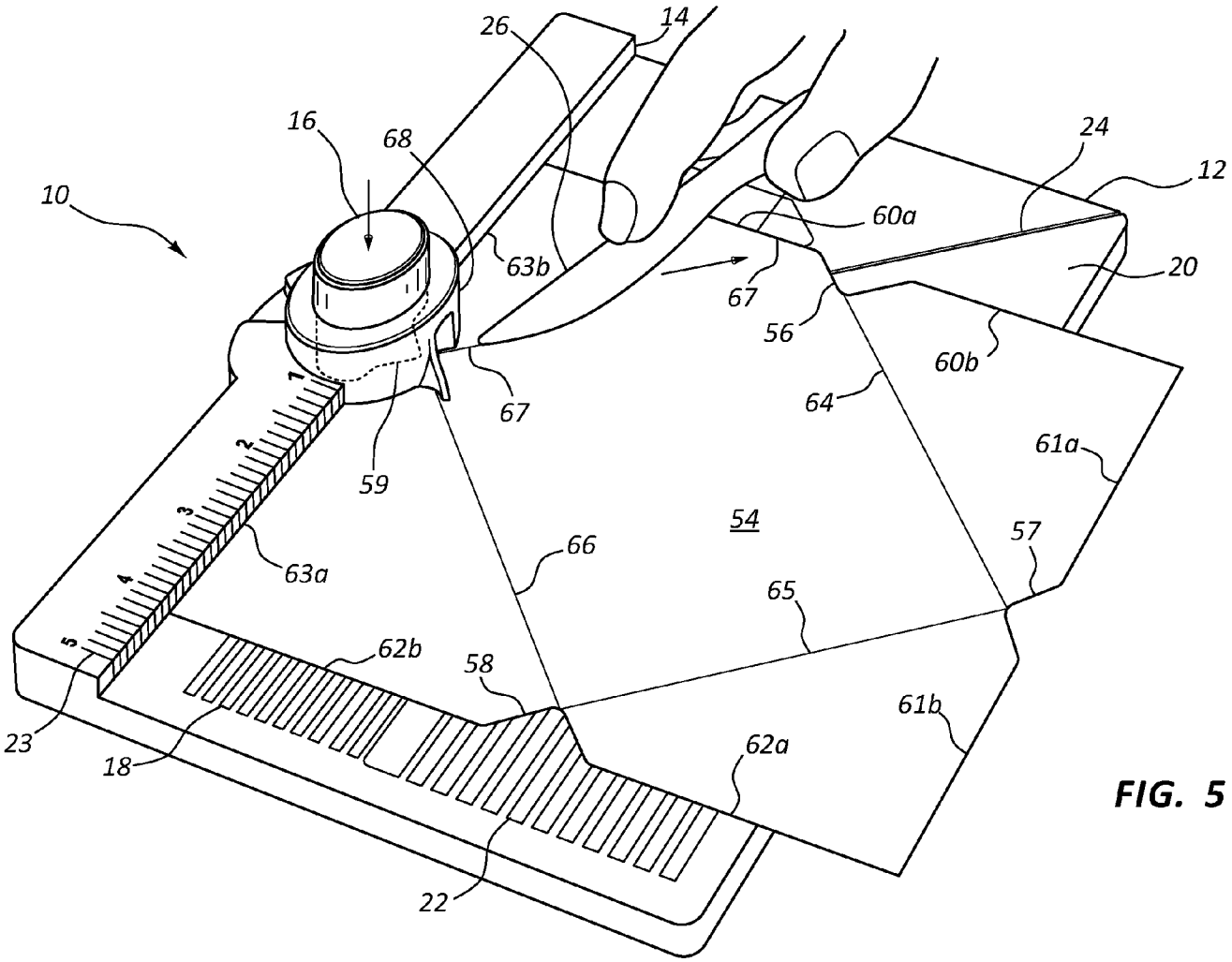
FIG. 5 is a three-dimensional drawing displaying the use of the scoring tool on a sheet of paper or other medium in a state further along in the process with concave "V" cuts and score lines.

FIG. 5 is a similar view of the punch and scoring system 10 to that in FIG. 4, other than it depicts the subsequent procedures required to proceed toward finishing the fabrication the flat pattern for the envelope.

As discussed in FIG. 4 above, the paper or other medium 54 at this point has had one concave "V" cut 56 punched into the paper edge 60 at the center of this paper edge 60 and one score line 64 has been scored in about a 45 degree angle across the paper or other medium 54. Now similar tasks are performed as discussed regarding FIG. 4 another three times, while rotating the paper or other medium 54 to the three remaining sides of the paper or other medium 54.

The next step is to rotate the paper or other medium 54 clockwise so that the next paper edge 61 lines up along the positioning edge 14, with its right edge lining up with the "score line" dimension on the edge scale 23. With the paper edge 61 in this position and held firmly in place, the user may then depress the punch tool 16 to cause the concave "V" cut 57 to be made in the middle of the paper edge 61.

Subsequent to the paper or other medium 54 being punched forming this concave "V" cut 57 at the center of the paper edge 61 of the paper or other medium 54, the user then again extracts the scoring tool 26 from the scoring tool slot 28. The scoring tool 26 is then again utilized to score or indent the paper or other medium 54, creating another score line 65 at about an angle of 45 degrees to the positioning edge 14 and the paper edge 61. As was the case earlier, the paper or other medium 54 is held in place to make sure that the paper edge 61 does not move from the proper edge scale 23 location. The paper edge 61 should be held in the same place as it was when making the concave "V" cut 57 and the paper or other medium 54 should be held in place. If it has moved, then the user would need to make whatever adjustment is required to line the corner of the paper edge 61 up with the proper "score line" dimension on the edge scale 23. When the paper edge 61 is properly lined up and held in place the user then applies pressure with the scoring tool 26 on top of the paper or other medium 54 immediately over the grooved score guide 24. The scoring tool 26 is then dragged over the top of the paper or other medium 54 while at the same time making sure that the scoring tool 26 remains in the grooved score guide 24. The paper or other medium 54 should be scored by the scoring tool 26 so that the width of the paper or other medium 54 from the punch tool housing 68 to the paper edge 62 is scored with a score line 65. This grooved score guide 24 and associated score line 65 are at an angle of about 45 degrees to the edge scale 23 and the paper edge 61.

Now that the steps have been accomplished on two sides of the envelope pattern, the paper or other medium 54 is rotated clockwise again so that paper edge 62 lines up along the positioning edge 14, with its right edge lining up with the "score line" dimension on the edge scale 23. With the paper edge 62 in this position and held firmly in place, the user may then depress the punch tool 16 to cause the concave "V" cut 58 to be made in the middle of the paper edge 62.

Subsequent to the paper or other medium 54 being punched forming this concave "V" cut 58 at the center of the paper edge 62 of the paper or other medium 54, the user then again uses the scoring tool 26 to score the paper or other medium 54 to create another score line 66 at an angle of about 45 degrees to the positioning edge 14 and the paper edge 62. As was the case earlier, the paper or other medium 54 should be held in place making sure that the paper edge 62 has not moved from the proper edge scale 23 location. The paper edge 62 should be held in the same place as it was when making the concave "V" cut 58 and prevented from moving. If it has moved, then the user will need to make whatever adjustment is required to line the corner of the paper edge 62 up with the proper "score line" dimension on the edge scale 23. When the paper edge 62 is properly lined up and held in place the user then applies pressure with the scoring tool 26 on top of the paper or other medium 54, over the grooved score guide 24. The scoring tool 26 is then dragged over the top of the paper or other medium 54, while at the same time making sure that the scoring tool 26 remains in the grooved score guide 24. The paper or other medium 54 is scored by the scoring tool 26 so that the width of the paper or other medium 54 from the punch tool housing 68 to the paper edge 63 (FIG. 4) is scored with a score line 66. This grooved score guide 24 and associated score line 66, is at an angle of about 45 degrees to the edge scale 23 and the paper edge 62.

Now that the steps have been accomplished on three sides of the envelope pattern, the user may now rotate the paper or other medium 54 clockwise again so that paper edge 63 lines up along the positioning edge 14, with its right edge lining up with the "score line" dimension on the edge scale 23. With the paper edge 63 in this position and held firmly in place, the user may then depress the punch tool 16 to cause the concave "V" cut 59 to be made in the middle of the paper edge 63.

Subsequent to the paper or other medium 54 being punched forming this concave "V" cut 59 at the center of the paper edge 63 of the paper or other medium 54, the user then again extracts the scoring tool 26 from the scoring tool slot 28. The scoring tool 26 is then again utilized to score or indent the paper or other medium 54, creating another score line 67 at an angle of 45 degrees to the positioning edge 14 and the paper edge 63. As was the case earlier, the paper or other medium 54 should be held in place making sure that the paper edge 63 has not moved from the proper edge scale 23 location. The paper edge 63 should be held in the same place as it was when making the concave "V" cut 59 and should not be allowed to move. If it has moved, then the user would need to make whatever adjustment is required to line the corner of the paper edge 63 up with the proper "score line" dimension on the edge scale 23. When the paper edge 63 is properly lined up and held in place, the user then applies pressure with the scoring tool 26 on top of the paper or other medium 54 immediately over the grooved score guide 24. The scoring tool 26 is then dragged over the top of the paper or other medium 54, while at the same time making sure that the scoring tool 26 remains in the grooved score guide 24. The paper or other medium 54 is scored by the scoring tool 26 so that the width of the paper or other medium 54 from the punch tool housing 68 to the paper edge 60 is scored with a score line 67. This grooved score guide 24 and associated score line 67, is at an angle of about 45 degrees to the edge scale 23 and the paper edge 63.

Now that the four concave "V" cuts have been made in each of the paper edges 60, 61, 62, and 63, smaller flap edges have been formed 60*a*, 60*b*, 61*a*, 61*b*, 62*a*, 62*b*, 63*a*, and 63*b*. These eight edges, in conjunction with the four score lines 64, 65, 66, and 67, complete the flat pattern, except for rounding the edges and forming corner radiuses 70, 71, 72, and 73 (FIG. 7). This will be discussed in the description of FIG. 6 that follows.

Figure 6:
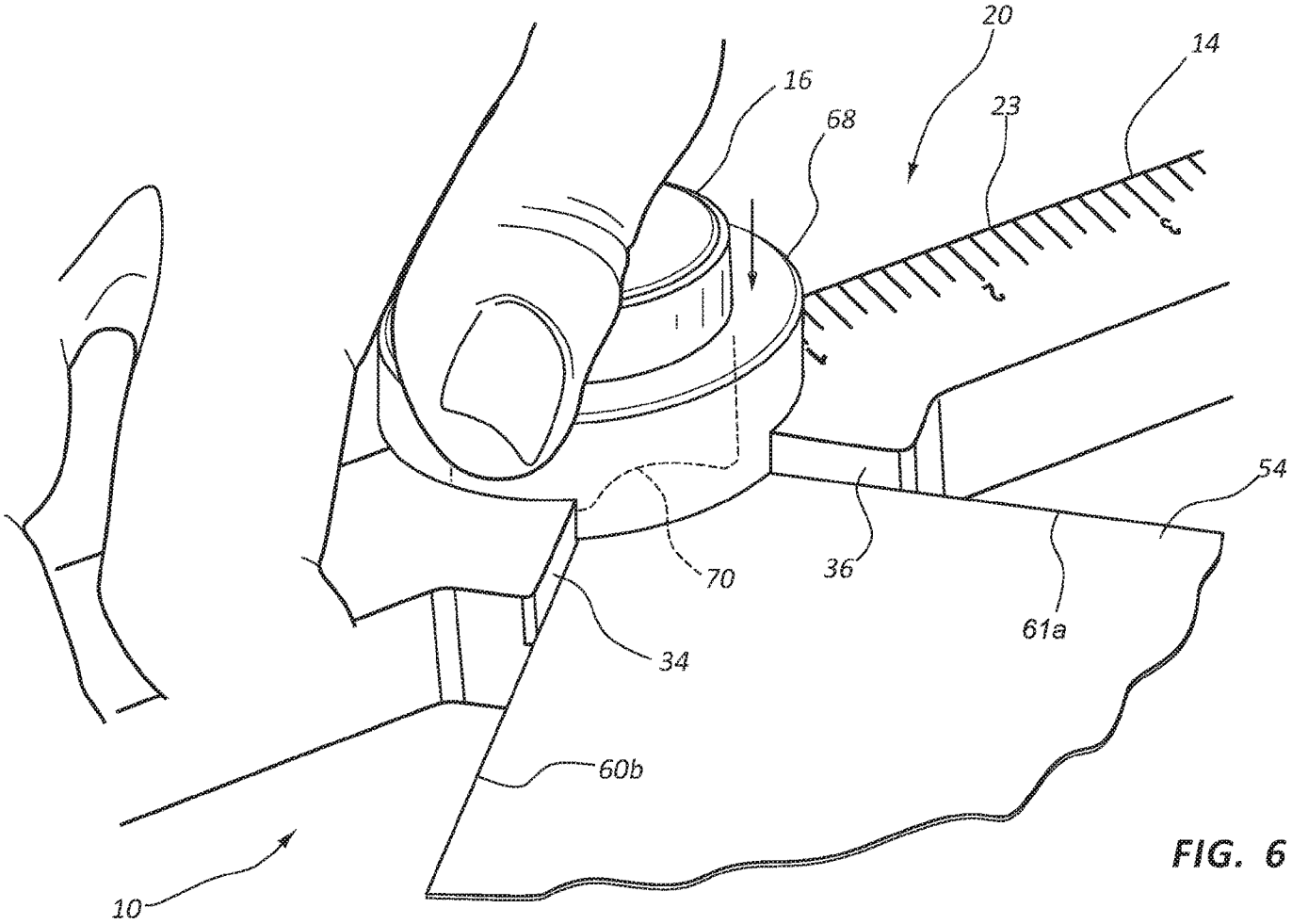
FIG. 6 is a detailed view of the system illustrating the use of a punch tool.
Figure 7:
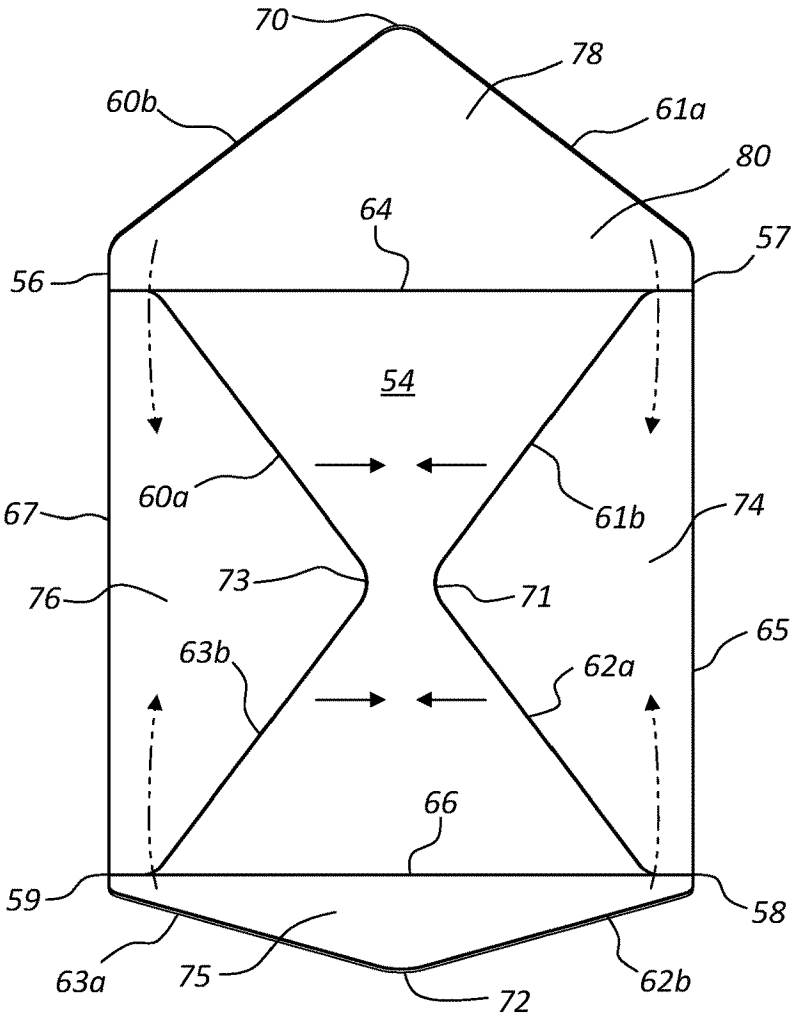
FIG. 7 is a top view of a paper or other medium in its cut and scored state with two sides of the envelope folded inward.

FIG. 6 illustrates the backside of the punch and scoring system 10. This view displays how the punch tool 16 may be used to trim the corners of the paper or other medium 54. The procedure begins with the corner formed by paper edges 60*b* and 61*a* placed under the punch tool 16 from the opposite side as was used to form the concave "V" cut 56, 57, 58, and 59 (FIG. 5), as described previously. The user, in this case, slips the corner of the flap, as defined by paper edges 60*b* and 61*a* under the punch tool 16. These two paper edges 60*b* and 61*a* should be lined up with the first corner guide 34 and the second corner guide 36 respectively as shown. While holding the paper or other medium 54 in place under the punch tool 16 and firmly against the two corner guides 34 and 36, the user then presses down firmly on the punch tool 16. The punch tool 16 then punches a full radius cut forming corner radius 70. This same procedure is repeated three additional times for each of the other three corners of the paper or other medium 54. When complete with this procedure, all four corners of the flat pattern have been given a full radius corner and the flat pattern is now complete and ready for folding and gluing or some other adhesion process to secure each of the flaps to form the completed envelope.

FIG. 7 shows the paper or other medium 54 with two adjacent flaps of the flat pattern folded along the score lines 65 and 67. Envelope flap 74 is formed in the area encompassed by flap edges 61*b* and 62*a*. Envelope flap 76 is formed by the area contained between flap edge 60*a* and 63*b*. Envelope flap 75 is formed by the area contained between flap edges 62*b* and 63*a*. Envelope closing flap 78 is formed by the area contained between flap edges 61*a* and 60*b*. The envelope flap 76 is folded inward toward the center as assisted by the score line 67 that was formed in the paper or other medium 54. Continue to fold this envelope flap 76 until it is lying flat against the paper or other medium 54 that now forms the back side of the envelope 80. Next, perform the same procedure on envelope flap 74, folding it at the score line 65. The third step in this process it to fold the third envelope flap 75 along the score line 66.

Figure 8:
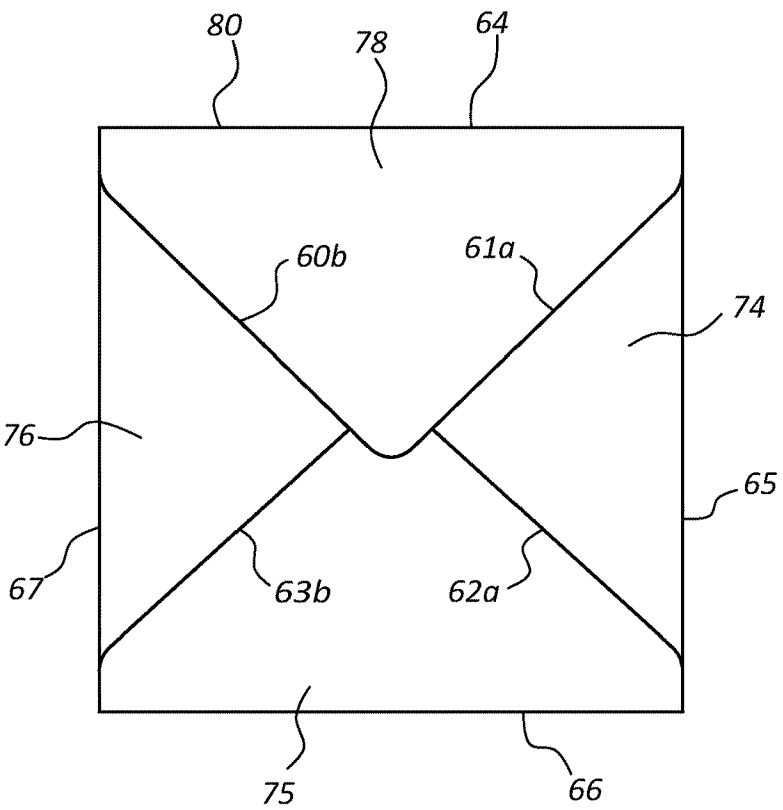
FIG. 8 is a top view of the paper or other medium illustrated in FIG. 7 in a folded state with bottom flap folded up and the top flap folded down.

FIG. 8 is another two dimensional view of the completed envelope with all the envelope flaps 74, 75, 76, and 78 folded, forming the completed structure of the envelope 80. Envelope flaps 74, 75 and 76 have been fully folded into position as has the envelope closing flap 78. To finish the envelope 80 the user adds glue or some other adhesion process, under envelope flap 75 at the flap edges 63*b* and 62*a*. This will effectively fasten envelope flap 75 to envelope flaps 74 and 76.

The envelope closing flap 78 may remain in an unfastened state, with no glue or other adhesion process, or glue or other adhesion process may be added under flap edges 60*b* and 61*a* to secure the contents of the envelope 80. This completes the steps to make an envelope with the punch and scoring system 10. The same procedure may be followed for making additional envelopes that are similar in size, or another size as selected from the instructions 18 as described with respect to FIG. 1.

The punch and scoring system is a simple template device that may be used by an inexperienced person to make envelopes, bags, boxes, containers and the like of various sizes one at a time. Knowing the desired size of a card to be inserted into an envelope, this system may incorporate instructions that specify the size of paper or other medium required to make a specific size envelope required for that specific card size. The user cuts the paper or other medium to the specified size. Holding the paper at specified locations as indicated by a scale contained on the punch and scoring system, the user then utilizes the punch device that is located in the body of the template to punch four small concave "V" cuts in the center of each of the four edges of the paper. This is done by rotating the paper four times, while locating the paper in the required scale location as specified on the template instructions.

Simplicity of operation of the punch and scoring system is obtained in several ways. The template is self-contained. Instruction and dimensions may be included on the face of the template so that no other device or manual is required. A diagram is also displayed showing how the finished paper cutout is to appear. Minimal cuts are needed to be made with scissors to form a square or a rectangle. There are concave "V" grooves for the inside corners of the folds, but they are simply made with a punch tool that is provided with the punch and scoring system. In addition to the concave "V" grooves being able to be punched with this device, one is also able to punch out corner radiuses in all four corners of the paper by utilizing the backside of the punch tool that is utilized for the concave "V" groove. No scissors, markings, or templates are required for these difficult cutouts. The fold lines are provided by simply scoring with a plastic scoring tool along a precut groove that is provided in the body of the punch and scoring system. The scoring tool is stored in the body of the punch and scoring system.

Reproducibility is maintained by using the aforementioned tools and features that are provided with the punch and scoring system, in conjunction with the measured scale and directions. The punch tool makes "V" shaped grooves that are the same since the same punch tool is used for each cut. The score line for the fold is positioned along the same line since it is made with a score line in the punch and scoring system. The directions on the body of the punch and scoring system show a matrix listing card size, paper size and score line (where the paper will be place relative to the scale that is provided on the body of the template of the punch and scoring system).

Multiple sizes of envelopes, bags, boxes, containers and the like are possible with the punch and scoring system. The details for making multiple sizes are displayed in a data matrix on the body of the punch and scoring system. Additional sizes may be added to this matrix, if desired.

There is a specific need for small production envelopes that are made to fit non-standard size cards, non-standard colors, that have specific items to insert into the envelopes, or that have the ability to fabricate a one-of-kind envelope out of a piece of paper or other medium that has been specifically made with special artwork or photography included as a part of the envelope.

Another feature for a small production envelope maker is that it should be simple to use and to understand. There is a need for envelopes that can be made by young children for various occasions, such as scrapbooking, special invitations, or a means of organizing various things in a novel way.

What is claimed is:

1. A device for punching and scoring a sheet of a medium to define an envelope from the sheet of the medium, the device comprising:

a base for supporting the sheet of the medium, the base including a support surface;

a positioning edge capable of guiding an edge of the sheet of the medium and of positioning the edge of the sheet of the medium, the positioning edge located at a fixed position along an edge of the support surface of the base and protruding upward relative to the support surface of the base;

a punch tool positioned at an intermediate location along the positioning edge, the punch tool including a cutter capable of cutting a notch at a notch point in the edge of the sheet of the medium when the edge of the sheet of the medium is located against the positioning edge; and a grooved score guide comprising an elongated channel extending linearly in the support surface of the base, the elongated channel extending from a location of the base against which a center of the cutter is to be positioned, in a fixed linear direction diagonal to the positioning edge, across at least a portion of the support surface of the base, the grooved score guide capable of defining a score line in the sheet of the medium at a location that extends from the notch point in the edge of the sheet of the medium to another edge of the sheet of the medium; and a scoring tool complementary to the grooved score guide and capable of movement along the grooved score guide to create a score line in the sheet of the medium.

2. The device of claim 1, further comprising a score guide locator to guide the sheet of the medium to a proper location for punching and scoring the sheet of the medium.

3. The device of claim 1, further comprising instructions on the device capable of assisting a user in positioning, punching, and scoring the sheet of the medium for a given size of envelope.

4. The device of claim 1, further comprising a sizing scale on the device capable of assisting a user in positioning, punching, and scoring the sheet of the medium for a given size of envelope.

5. The device of claim 1, further comprising a diagram illustrating an envelope to be defined by the device from the sheet of the medium.

6. The device of claim 5, further comprising a sizing scale on the device to assist a user in positioning, punching, and scoring the sheet of the medium for a given size of envelope.

7. The device of claim 1, further comprising an edge scale on the positioning edge to assist a user in positioning the sheet of the medium at a proper location along the positioning edge.

8. The device of claim 1, wherein the cutter of the punch tool comprises a first cutting tool and a second cutting tool, the first cutting tool capable of cutting the sheet of the medium at the notch point and the second cutting tool capable of cutting a corner radius on an outside corner of an envelope cutout defined from the sheet of the medium.

9. The device of claim 8, wherein the first cutting tool is positioned over the support surface of the base and is accessible from a first side of the positioning edge and the second cutting tool is accessible from an opposite, second side of the positioning edge.

10. The device of claim 9, wherein the first cutting tool and the second cutting tool are actuated at the same time by the pressing a button of the punch tool.

11. The device of claim 8, wherein the punch tool includes a corner guide capable of receiving the outside corner of the envelope cutout defined from the sheet of the medium and of positioning the outside corner of the envelope cutout defined from the sheet of the medium with beneath the second cutting tool.

12. An apparatus for punching and scoring paper to create an envelope, the apparatus comprising:

a main body including a base with a support surface;

a punch tool on the main body above the support surface, at an intermediate location along an edge of the base, the punch tool including a first cutting tool and a second cutting tool with a single actuation point, the first cutting tool capable of cutting a "V" cut at a notch point in an edge of the paper, the second cutting tool capable of cutting a corner radius on an outside corner of an envelope cutout defined from the paper; and a grooved score guide comprising an elongated channel formed in the support surface of the base of the main body, the grooved score guide extending diagonally in a fixed direction across at least a portion of the support surface of the base from a location beneath the first cutting tool of the punch tool to a location adjacent to another edge of the support surface of the base for creating a score line in the paper from the notch point in the edge of the paper, across the paper, to another edge of the paper.

13. The apparatus of claim 12, further comprising a positioning edge disposed at a fixed location on the main body and capable of guiding an edge of the paper and of positioning an edge of the paper on the support surface of the main body at a location beneath the punch tool.

14. The apparatus of claim 13, further comprising an edge scale on the positioning edge to assist a user in positioning the paper at a proper location along the positioning edge.

15. The apparatus of claim 12, further comprising instructions and a sizing scale on the support surface of the main body to assist a user in punching and scoring the paper for a given size of envelope.

16. The apparatus of claim 12, wherein the first cutting tool is positioned over the support surface of the base and is accessible from beneath a first edge of the punch tool that extends over the support surface and the second cutting tool is accessible from an opposite, second edge of the punch tool.

17. The apparatus of claim 12, wherein the punch tool includes a corner guide capable of receiving an outside corner of an envelope cutout defined from the paper and of positioning the outside corner of the envelope cutout defined from the paper beneath the second cutting tool.

18. A device for punching and scoring paper to create an envelope, the device comprising:

a main body including a base with a support surface;

a positioning edge defined by the main body and protruding upward from a fixed location on the base, the positioning edge capable of guiding an edge of the paper and of positioning the paper;

a punch tool on the main body over an intermediate location of the positioning edge, the punch tool including a first cutting tool and a second cutting tool with a single actuation point, the first cutting tool capable of cutting a "V" cut at a notch point on the edge of the paper, the second cutting tool capable of cutting a corner radius on an outside corner of an envelope cutout defined from the paper, the first cutting tool being positioned over the support surface of the base on a first side of the positioning edge and the second cutting tool being accessible from an opposite, second side of the positioning edge; and a grooved score guide comprising an elongated channel in the support surface of the base of the main body, the elongated channel extending linearly from a location beneath the first cutting tool of the punch tool, in a fixed, linear direction diagonal to the positioning edge, across at least a portion of the support surface to a location adjacent to another edge of the base, the grooved score guide capable of defining a score line in the paper from the notch point on the edge of the paper, diagonally across the paper to another edge of the paper.

19. The device of claim 18, further comprising an edge scale on the positioning edge to assist a user in positioning the paper at a proper location along the positioning edge.

20. The apparatus of claim 18, wherein the punch tool includes a corner guide capable of receiving an outside corner of an envelope cutout defined from the paper and of positioning the outside corner of the envelope cutout defined from the paper beneath the second cutting tool.

* * * * *